United States Patent [19]

Boller

[11] 4,241,841

[45] Dec. 30, 1980

[54] SEVERABLE CONNECTING MEANS

[75] Inventor: Peter K. Boller, Willowdale, Canada

[73] Assignee: Consumers Glass Company Ltd., Etobicoke, Canada

[21] Appl. No.: 36,764

[22] Filed: May 7, 1979

[51] Int. Cl.[3] ..... B65D 41/48

[52] U.S. Cl. ..... 215/252

[58] Field of Search ..... 215/252, 253, 251, 250

[56] References Cited

U.S. PATENT DOCUMENTS

| | | | |
|---|---|---|---|
| 3,329,295 | 7/1967 | Fields | 215/252 |
| 3,809,365 | 5/1974 | Loffler | 215/253 |
| 3,809,370 | 5/1974 | Sugasaga | 215/256 |
| 3,901,403 | 8/1975 | Menke | 215/251 |
| 4,156,490 | 5/1979 | Peraboni | 215/252 |

*Primary Examiner*—Donald F. Norton

[57] ABSTRACT

A twist breaking plastic guarantee seal having a cap portion and a depending skirt portion interconnected by ribs. A skirt portion has a greater inside diameter that the outside diameter of said cap portion and stop means are provided between these two diameters. The skirt portion is adapted for securement to a container neck exterior and the seal is broken by twisting the cap portion relative to the skirt. During application of the cap, to a container predetermined amount of axial movement of the cap relative to the skirt portion occurs, causing the interconnecting ribs to flex and weaken. The twisting of the cap relative to the skirt causes shearing of the ribs and allows the cap to be removed.

10 Claims, 6 Drawing Figures

SEVERABLE CONNECTING MEANS

FIELD OF THE INVENTION

This invention relates to severable connecting means for joining two components that allows a predetermined amount of movement of the components towards each other and fails by twisting one component relative to the second component. More particularly, the invention may be used as a two component guarantee seal adapted for twist removal by the end user.

BACKGROUND OF THE INVENTION

Guarantee seals per se are well known with typical examples including metal caps, having a lower pilfer indicating severable ring that is retained on the neck of the bottle, and glued paper string seals that are commonly used on liquor bottles. It is common in the wine industry to use paper foil which has been wrapped on the bottle to indicate to the customer that no one has tampered with the contents of the bottle after it has left the factory.

With wide spread use of easily molded plastic various plastic guarantee seals have been proposed. The most commonly used plastics are polyethylene and polypropylene due to their good forming properties and resiliency. However, these materials are quite strong in shear strength and do not tear easily, therefore certain problems have resulted when the user tries to break the seal. This particular problem is identified in Canadian Pat. No. 815,366 which discloses a widely accepted guarantee seal comprising a cap portion and a skirt portion separated by a band. The problem of breaking the seal, i.e. causing a tearing action of a portion of the plastic seal, is overcome by allowing the user to progressively break each rib joining the band to the cap and the skirt. This provides a satisfactory system that can easily be opened although, certain problems arise in manufacturing this seal. Another problem is once the separable band has been torn by the user a redundant plastic strip is left in the users hands and this band often becomes litter.

The particular design in Canadian Pat. No. 815,366 uses the combined strength of the ribs to ensure the closure does not collapse when it is being applied to a container. In order to provide this axial strength the spacing between adjacent ribs is quite small which implies the mold must be quite detailed and precise. As the mold wears flashing (the formation of a thin web of material in what should be a gap) may occur between ribs thereby increasing the strength required to remove the band. The present invention overcomes these problems due to its unique structure that incorporates a stop mechanism which provides the required axial strength for application thereby allowing the ribs to be spaced further from one another and reducing the likelihood of flashing.

SUMMARY OF THE INVENTION

The present invention is a severable connecting means joining two components comprising an area of reduced strength relative to the components and including a stop means. The area of reduced strength allows movement of the components towards each other and the stop means serves to limit this movement. The area of reduced strength fails by twisting one of the components relative to the other component.

According to an aspect of the invention, the connecting means is used in a plastic guarantee seal having a cap portion and a depending skirt portion spaced by the area of reduced strength defined by the connecting means. The skirt portion has been adapted for securement to the container neck exterior when forced thereon by applying a force on the cap portion. A stop mechanism is provided that limits the relative axial movement between the skirt portion and cap portion and provides the axial strength required for the application of the closure. The seal is broken by applying a twisting action to the cap portion relative to the skirt portion, causing shearing of the area of reduced strength.

According to another aspect of the invention the area of reduced strength includes interconnecting members and any relative axial movement between the cap portion and skirt portion causes the interconnecting members to flex slightly thereby weakening the interconnecting member and reducing the force necessary to shear these members.

BRIEF DESCRIPTION OF THE DRAWINGS

Preferred embodiments of the invention are shown in the drawings wherein.

DETAILED DESCRIPTION OF THE PREFERRED EMBODIMENTS

Although the present invention is related to a severable connecting means, it will be described in relation to the particular application of the connecting means as a guarantee seal. However, the present invention is not limited to this particular application of the connecting means.

Figure 1:
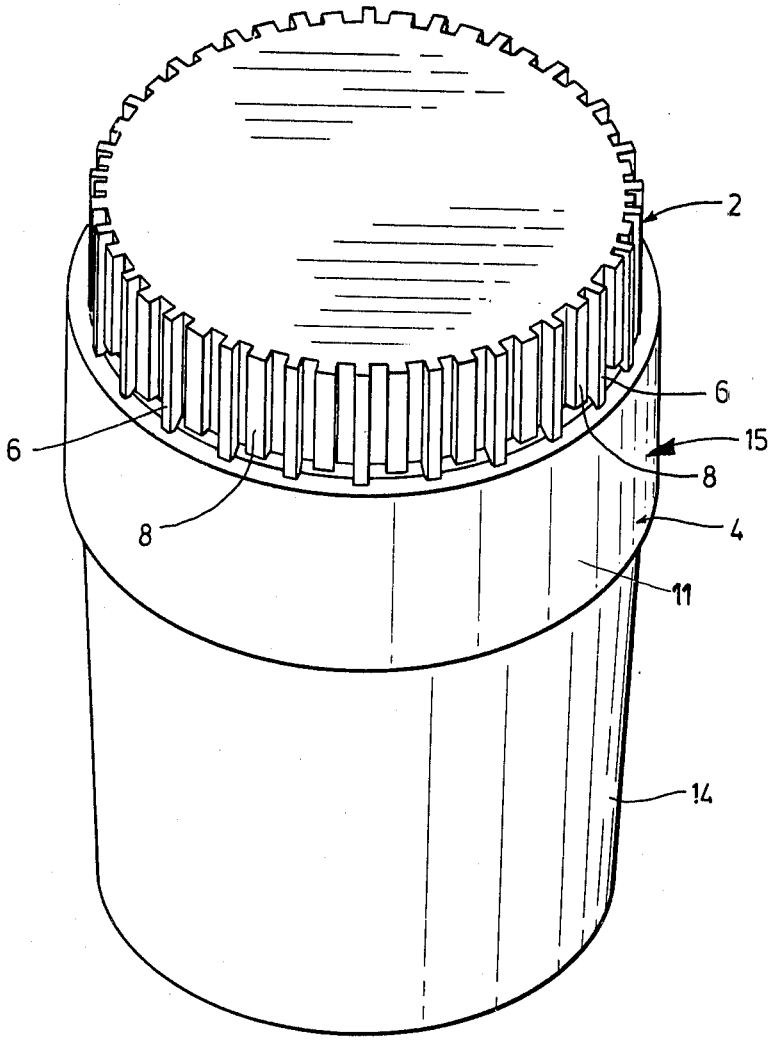
FIG. 1 is a perspective view of a guarantee seal of this invention.
Figure 2:
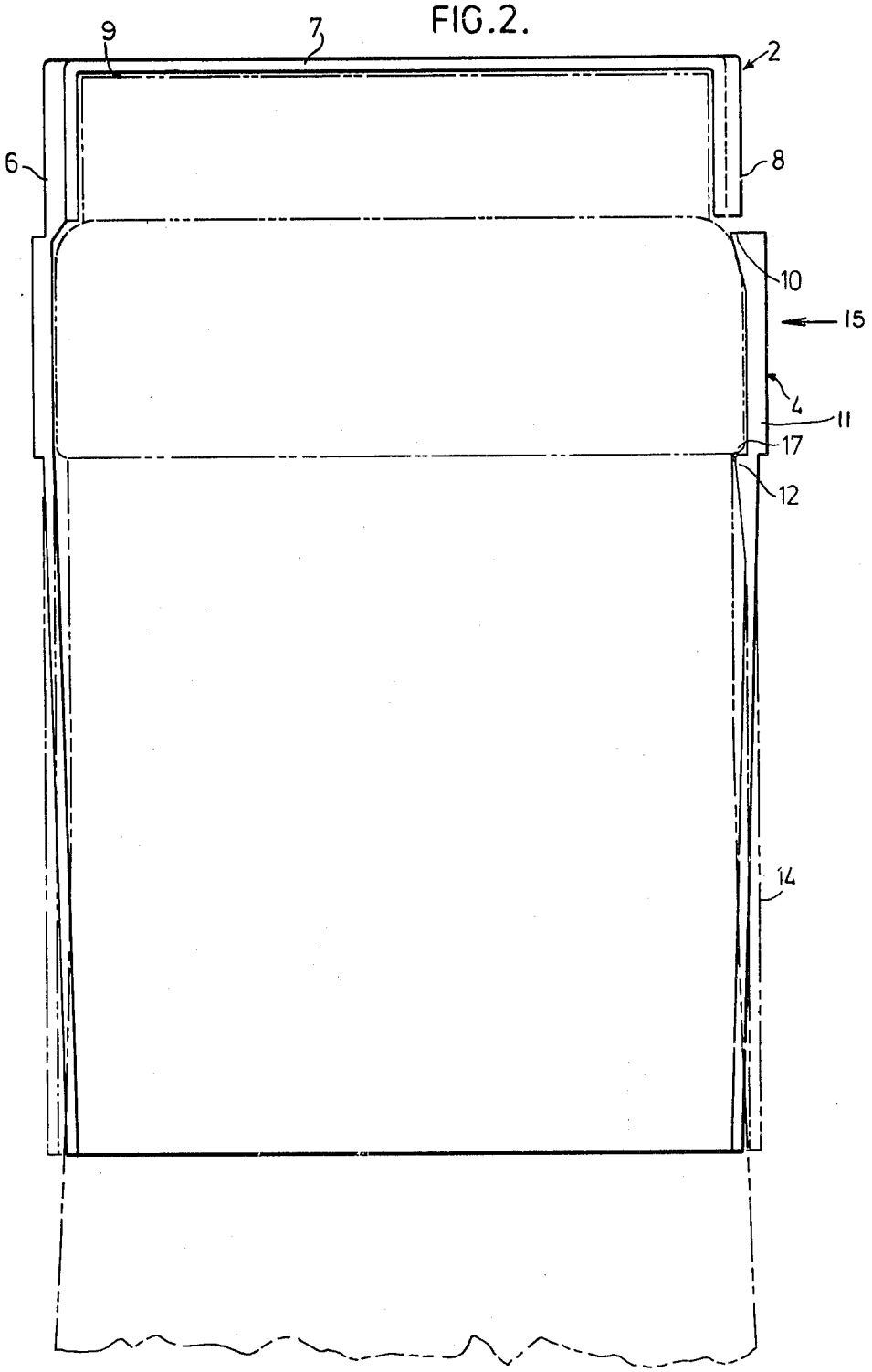
FIG. 2 is a vertical section taken through the centre of the guarantee seal of FIG. 1 after it has been applied to the neck of a container.

The guarantee seal closure as shown in FIG. 1 comprises a cap portion 2 and a lower skirt portion 4 interconnected by ribs 6. Stop portions 8 are located between ribs 6 and terminate at the lower edge of the cap portion 2. As shown in FIG. 2 corresponding stop portions 10 have been provided at the upper edge of the skirt portion 4 and project inwardly of the skirt portion to provide an abutment surface for the cap stop portions to engage during axial compression of the cap relative to the skirt. The interconnecting ribs 6 as shown in FIG. 2 are tapered with respect to the portion of the rib located between the upper edge of the skirt portion and the lower edge of the cap portion, and as such provide an example of a connecting means having an area of reduced cross-section that will more readily flex when the closure is applied to a container.

As can be observed in FIGS. 1 and 2 the rib portions are spaced about the periphery of the cap and the stop portions are located between the ribs. In this particular embodiment the cap portion 2 has an outside diameter less than the outside diameter of the skirt portion 4, while the circle formed by the outside edge of the stop portions 8 has a diameter less than the inside diameter of the skirt portion 4. The circle formed by the outside edges of the rib portion 6 has a diameter greater than the inside diameter of the skirt portion but less than the outside diameter of the skirt portion. Other structures may be possible, for example the cap portion could be of greater diameter than the skirt portion, however, the design of the structure should allow relative movement between the cap portion and the skirt portion, and further include a stop mechanism designed to limit the axial compression of the closure between the cap portion and the skirt portion.

The ribs 6 project upwardly along the outside of the cap portion 2 and as such provide a corrugated type exterior on the cap which assists the user in securely grasping the cap and twisting it relative to the skirt portion. The top portion of the cap 2 is normally a continuous panel 7 such that the cap can be replaced on the bottle after the seal has been broken to provide a dust cover, and to limit the inter-change of air from within the bottle to the atmosphere. As shown in FIG. 2 the mouth of the container 9 is immediately below the continuous panel when the closure has been applied. The skirt portion 4 comprises an upper locking portion 15 and a lower lead in portion 14. The upper locking portion includes an enlarged band portion 11 and locking members 12 for maintaining the skirt portion 4 on the neck of the container. The locking members 12 snap beneath a shoulder 17 provided on the neck of the container and provide a simple efficient method for locking the skirt to the container neck although other designs may also be possible.

The skirt portion extends a substantial distance down the neck of the container by means of the lead in portion 14 which readily deforms to the shape of the container. This lead in portion 14 normally has to expand to fit the lower portion of the container neck and provides a snug fit which reduces the tendency of the skirt portion to rotate when the cap is twisted relative to the skirt. The lead in portion also provides a greater surface for the user to grasp and assists the user in twisting the cap relative to the skirt.

Figure 3:
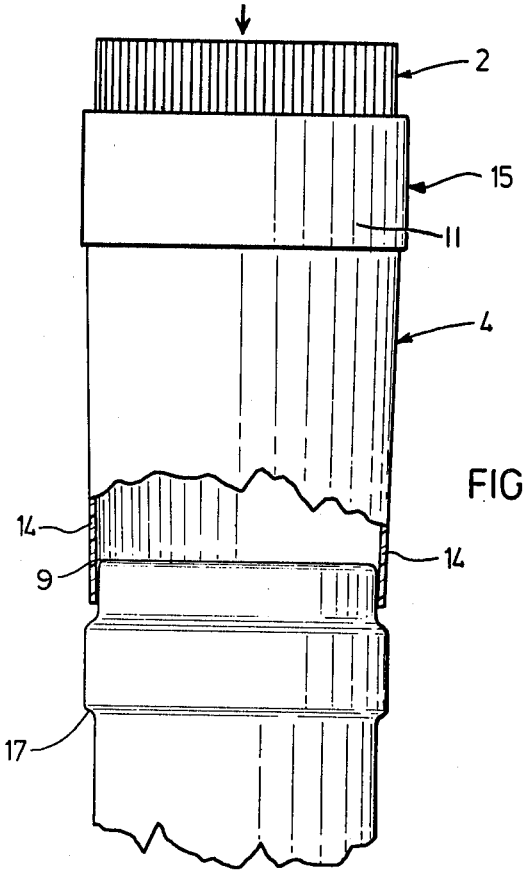
FIG. 3 shows the guarantee seal during the first stages of application to a container neck exterior.
Figure 4:
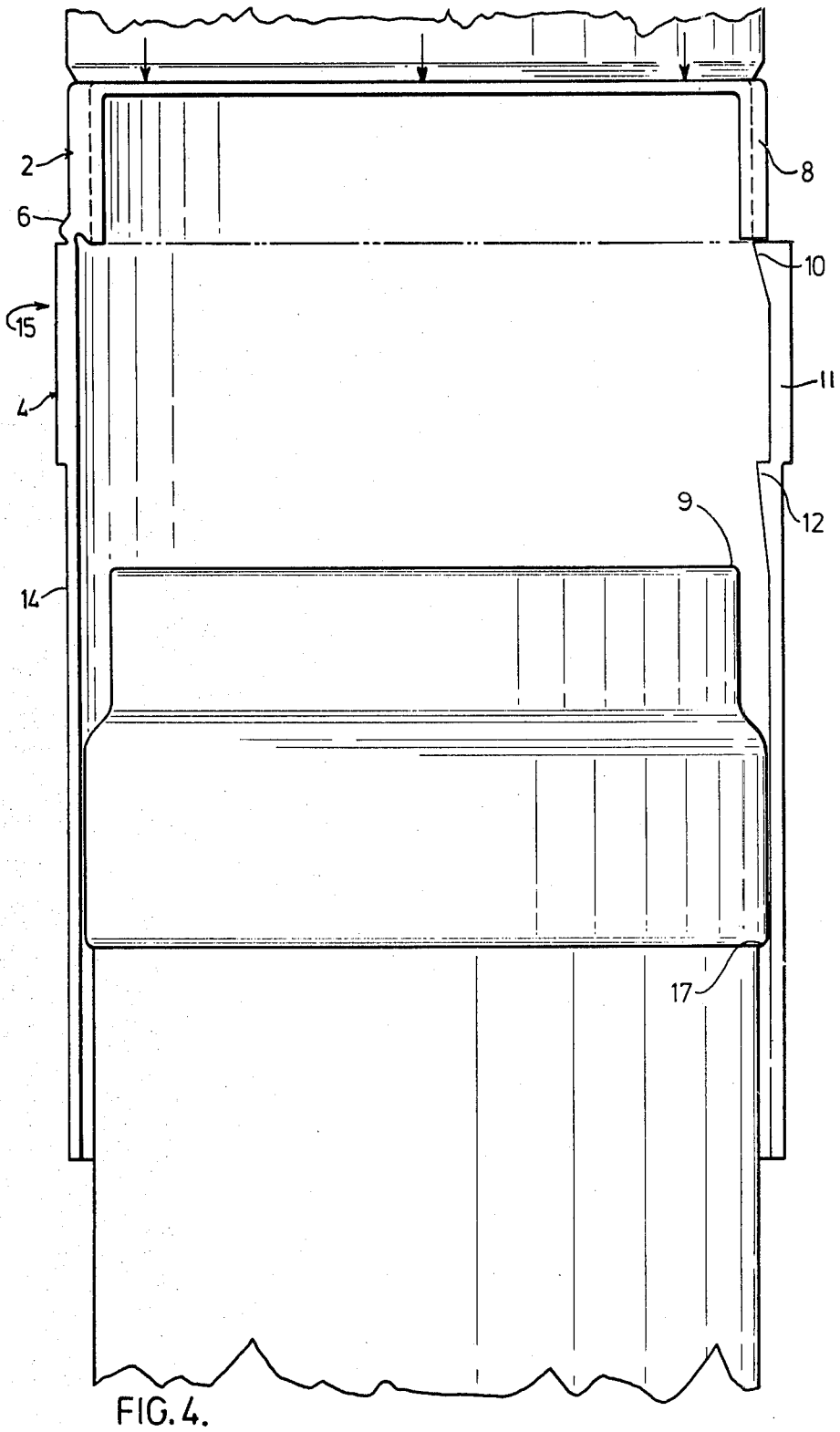
FIG. 4 shows the guarantee seal when partially applied to the container neck exterior.

FIGS. 3, and 4 show various stages during the application of the closure to the neck of a container. FIG. 2 illustrates the cap when fully applied to the neck of the container. In FIG. 3 the lead in portion 14 of the skirt is aligned with the container neck exterior, and the closure has been partially applied. The extreme lower edge of the lead in portion is very deformable and sized to provide a loose fit with the mouth of the container and serves to align the closure with the neck of a container during application. The closure continues to be thrust downwardly over the container neck causing a very slight action in the container skirt and relative axial movement between the cap portion and the skirt. The relative axial movement between the cap and the skirt is limited by interaction of stop portions 8 and 10 assuring the cap does not completely telescope within the skirt. A force of approximately 80 pounds is normally used to apply the closure to a container and therefore the axial rigidity of the closure is substantial and at least approximately equal to the frictional force opposing the application of the seal to the container.

Also, because of tolerance variations in the containers, the seals must be capable of withstanding a certain amount of lateral force during application of the seal. For example, in glass containers such as wine bottles it is quite common due to tolerance variations for the axis of the mouth of a container to be an angle of several degrees from the vertical. However, closures of this type are usually forced downwardly during application and a lateral force results due to this angle variation. Other lateral forces may develop due to a slight misalignment of the container in the capping machine or a misalignment of the closure in the capping machine. Therefore, interconnecting rib portions must have sufficient strength not to shear or fracture due to the presence of these lateral forces. Polyethylene and polypropylene have been found quite satisfactory for guarantee seals normally applied to wine bottles, however, other materials may also be suitable.

Figure 5:
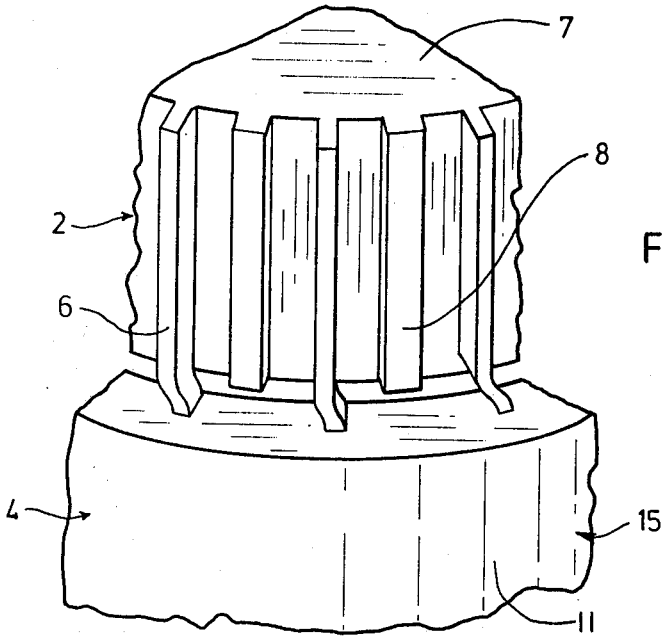
FIG. 5 shows one possible flexing action of the ribs during application of the seal to a container and FIG. 6 shows a partial perspective of the initial stages of shearing of the ribs during the removal of the cap.

As the seal is being applied to the container the air located within the guarantee seal is vented to the atmosphere through the gaps provided between the stop portions 8 and 10 the rib portions 6. Therefore there is no substantial build up of pressure as the closure is applied to a container. During the application of the closure the portion of the ribs spacing the cap and skirt, flex. This flexing action of the ribs could be in the form of buldging of the ribs outwardly as shown in FIG. 4 or possibly a slight rotation of the cap relative to the skirt as shown in FIG. 5. The extent of this flexing is limited as the stop portions 8 and 10 interact with one another. The flexing of the ribs during application of the seal weaken the ribs and reduce the force necessary to remove the cap from the skirt. The stop portions are designed and sized such that a slight rotation of the cap relative to the skirt does not significantly affect their efficiency.

One particular design of the seal which has been found particularly useful for application to wine bottles has a diameter of approximately 30 millimeters and an overall height of approximately 50 millimeters. The spacing between the cap and the skirt is approximately 0.5 millimeters and the ribs are equally spaced about the circumference of the cap at about 15 degree intervals. Each rib has a minimal cross-sectional area of 0.06 square millimeters and the exterior edge of the ribs 6 are spaced outwardly of the interior edge of the skirt approximately 0.25 millimeters.

The number of ribs and the cross-sectional area of the ribs will vary according to the torque desired to cause shearing of the ribs. If a greater torque is desired, for example to prevent children from opening the container more ribs or a larger minimal cross-sectional area can be provided and the actual number and area of the ribs will vary according to the desired torque for separation. This may also be accomplished by selecting plastic materials of suitable toughness to use in the seal. Also the size of the stop portions on the cap and the skirt will vary according to the axial force required to apply the seal to a container. With this particular design there are 24 stop portions on the cap, however, there are only 18 stop portions in the lower skirt. Two gaps have been provided diagonally across from each as a result of a particular moulding technique used. Therefore it is not necessary that all stop portions on the cap have corresponding stop portions in the skirt. The effective contacting area of corresponding stop portions is approximately 0.4 square millimeters and the stop portions are essentially centered between adjacent ribs. The exterior periphery of the stop portions located on the cap are spaced inwardly of the interior of the skirt approximately 0.1 millimeters and upwardly of the skirt approximately 0.5 millimeters. A guarantee seal of this particular design when made of a polyethylene can withstand an axial application force of approximately 100 pounds and only requires a torque of approximately 10 inch pounds applied to the cap to shear the ribs.

Figure 6:
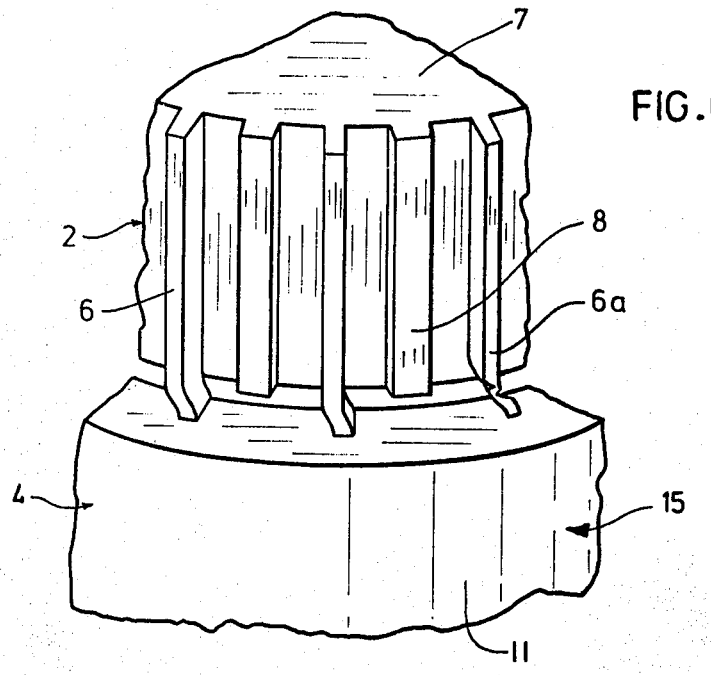

During removal of the cap portion from the skirt portion the interconnecting ribs are severed due to a twisting action of the cap portion relative to the skirt portion as shown in FIG. 6. The exact mechanism by which the ribs are broken is not fully known, however it is hypothesized that the tapered portion of the ribs stretch due to the rotation of the cap portion relative to the skirt portion and this stretching of the ribs reduces the cross sectional area of the ribs somewhat. The shear stress increases with this reduction in cross-sectional area and eventually causes failure of the ribs. As soon as one rib fails the shear stress in the remaining ribs increases causing other ribs to fail. The actual point of failure may occur at the point of minimal cross-sectional area of each rib although it could occur at another point due to flaws such as air bubbles or molding variations. FIG. 6 shows one rib *6a* of the closure initiating shearing as the cap is twisted relative to the skirt.

As mentioned previously flashing (the formation of a thin web of material in what should be a gap) is a problem in prior art closures. The unique design of the present invention allows the interconnecting rib members to be spaced further apart while also providing a stop mechanism that uses components initially spaced from one another minimizing the problem of flashing. Furthermore, as the mold wears flashing will not immediately occur due to the significant spacing of the closure components.

The present invention provides a two piece guarantee seal which can withstand the relative high axial force required for applying the closure to a container, while also providing a seal which can easily be broken without the necessity of any tools by the end user. The particular two piece design reduces problems of litter associated with tearable band guarantee seals, and it also provides a cap which can be replaced on the bottle as a dust cover which serves to limit the air exchange between the container and the atmosphere.

The application of the closure to the container causes flexing of the interconnecting ribs, weakening the ribs and preparing the closure for breakage by the user. This preparatory action (flexing of the ribs) reduces the force necessary to separate the cap from the skirt and results in a closure which has reduced strength after application to a container. However, the closure has the higher strength during the first stages of application of the closure to a container where lateral forces may be present as well as during bulk packaging of individual closures. The present design is capable of being molded by existing techniques and can be applied to the neck of containers which vary within existing bottle tolerances. A closure of the present invention further provides a seal which can be packaged in bulk and is not vulnerable to damage or breakage.

Although various embodiments of the invention have been described herein in detail it will be understood by those skilled in the art that variations may be made thereto without departing from the spirit of the invention or the scope of the appended claims.

The embodiments of the invention in which an exclusive property or privilege is claimed are defined as follows:

1. A twist breaking plastic guarantee seal comprising a cap portion and a depending skirt portion, said skirt portion having an inside diameter at the upper extremity thereof greater than the outside diameter of said cap portion and adapted for securement to a container neck exterior, interconnecting ribs joining and spacing said cap portion and skirt portion at spaced positions about the periphery of said cap, stop means located between the outside diameter of said cap portion and the inside diameter of said skirt portion adjacent the upper extremity thereof to predetermine the extent of axial movement of said cap portion relative to said skirt portion and the extent to which said ribs are flexed during application of said seal to a container, said ribs shearing on twisting said cap portion relative to said skirt portion to break said seal and allow said cap to be removed.

2. A plastic guarantee seal as claimed in claim 1 wherein said ribs extend upwardly along the outside of said cap portion to facilitate grasping of said cap, and wherein said stop means includes interacting cap and skirt shoulders such that said shoulders are axially aligned and located between the exterior of said cap portion and the interior of said skirt portion and wherein the stop portions are located between adjacent ribs.

3. A plastic guarantee seal as claimed in claim 1 wherein said cap portion is adapted for re-application to the container after said seal is broken and providing a friction fit with the container.

4. A guarantee seal as claimed in claim 1 wherein the flexing of said ribs during application of said seal to a container weakens said ribs and reduces the force necessary to twist remove said cap portion.

5. A guarantee seal as claimed in claim 4 wherein said seal can withstand an axial compressive force during application to a container after initial movement of said cap and skirt portions of approximately 80 lbs force and wherein the force required to shear said ribs is approximately 10 lbs force applied tangentially to the periphery of said cap portion.

6. A guarantee seal as claimed in claim 1 wherein the shear strength of said ribs is greater prior to application to a container than after such application has been completed.

7. A guarantee seal as claimed in claim 1 wherein the total minimal cross-sectional area of said interconnecting ribs is significantly less than the effective contacting area of said stop portions.

8. A plastic guarantee seal as claimed in claim 1 wherein said skirt is at least $\frac{3}{8}$" in length.

9. A plastic guarantee seal as claimed in claim 8 wherein the axial spacing between said cap and said skirt is approximately twenty thousandths of an inch.

10. A plastic guarantee seal as claimed in claim 9 wherein the plastic is polyethylene or polypropylene and wherein the circumferential spacing between ribs is approximately 15°.

* * * * *